United States Patent [19]

Asano

[11] 4,109,615

[45] Aug. 29, 1978

[54] APPARATUS FOR CONTROLLING THE RATIO OF AIR TO FUEL OF AIR-FUEL MIXTURE OF INTERNAL COMBUSTION ENGINE

[75] Inventor: Masaharu Asano, Yokohama, Japan

[73] Assignee: Nissan Motor Company, Limited, Japan

[21] Appl. No.: 624,294

[22] Filed: Oct. 20, 1975

[30] Foreign Application Priority Data

Oct. 21, 1974 [JP] Japan ..... 49/121168
May 14, 1975 [JP] Japan ..... 50/55985

[51] Int. Cl.[2] ..... F02M 7/00; F02B 3/00

[52] U.S. Cl. ..... 123/32 EE; 123/119 EC; 60/276; 60/285

[58] Field of Search ..... 123/32 EA, 32 EE, 119 EC; 60/274, 276, 285

[56] References Cited

U.S. PATENT DOCUMENTS

| | | | |
|---|---|---|---|
| 3,425,401 | 2/1969 | Lang | 123/32 EA |
| 3,827,237 | 8/1974 | Linder | 60/274 |
| 3,875,907 | 4/1975 | Wessel | 123/32 EA |
| 3,923,016 | 12/1975 | Hoshi | 123/32 EA |
| 3,973,529 | 8/1976 | Wessel | 123/32 EE |

*Primary Examiner*—Ronald B. Cox
*Attorney, Agent, or Firm*—Robert E. Burns; Emmanuel J. Lobato; Bruce L. Adams

[57] ABSTRACT

A differential signal generator receives an exhaust gas sensor signal and a reference signal, one of which is discretely or continuously modified by an engine temperature sensor signal, to generate a differential signal. This signal is applied to an air to fuel ratio control means to expedite a cold engine start.

9 Claims, 10 Drawing Figures

APPARATUS FOR CONTROLLING THE RATIO OF AIR TO FUEL OF AIR-FUEL MIXTURE OF INTERNAL COMBUSTION ENGINE

BACKGROUND OF THE INVENTION

The present invention relates generally to an apparatus for feedback control of the ratio of air to fuel of the air-fuel mixture supplied to an internal combustion engine, and particularly to an apparatus for the above-mentioned feedback control which senses low temperature of the engine to supply a rich air-fuel mixture to the engine in order to ensure cold engine start.

Various apparatuses have been proposed to supply an optimum air-fuel ratio of the air-fuel mixture to an internal combustion engine for reduction of noxious components contained in exhaust gases, one of which is an apparatus using the concept of feedback control of the air-fuel ratio of the air-fuel mixture. The apparatus generally comprises a sensor, such as an oxygen analyzer, for sensing a component of the exhaust gases and generating an electrical signal representative thereof, a differential signal generator being connected to the sensor for generating an electrical signal representative of the differential value between the signal from the sensor and a reference signal, and control circuit connected to the differential signal generator for controlling an actuator such as an electromagnetic valve, which is attached, for example, to a fuel supply conduit of a carburetor, in response to the differential value therefrom to regulate the mass ratio of air to fuel.

SUMMARY OF THE INVENTION

In the above described prior art, however, there is a disadvantage in that particular attention has not been paid to ensure cold engine start during which a rich air-fuel mixture is required. The present invention, therefore, is to supply an adequate air-fuel mixture to the engine at cold engine start by sensing low engine temperature. One measure to attain the above, according to the present invention, is to change the value of the reference signal in response to low engine temperature.

It is, therefore, an object of the present invention to modify the above-mentioned conventional feedback control apparatus in order to ensure cold engine start by sensing low temperature of the engine.

Another object of the present invention is to modify the above-mentioned conventional feedback control apparatus to ensure cold engine start by gradually and continuously changing the value of the reference signal in response to low temperature of the engine.

Still another object of the present invention is to modify the above-mentioned conventional feedback control apparatus to ensure cold engine start by discretely changing the signal value from the sensor in response to the low temperature of the engine.

BRIEF DESCRIPTION OF THE DRAWINGS

These and other objects, features and many of the attendant advantages of this invention will be appreciated more readily as the invention becomes better understood by the following detailed description, when considered in connection with the accompanying drawings, wherein.

DESCRIPTION OF THE PREFERRED EMBODIMENTS

Figure 1:
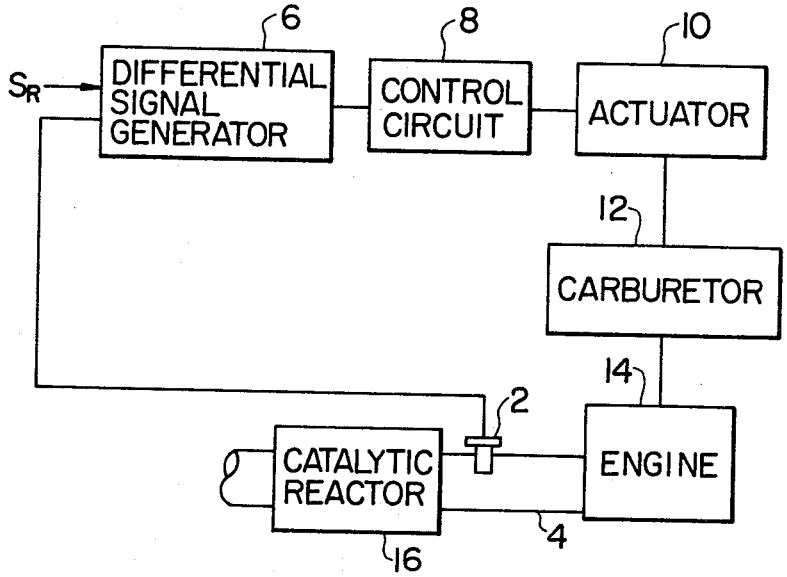
FIG. 1 is a functional block diagram of a conventional apparatus for feedback control of the ratio of air to fuel of the air-fuel mixture supplied to an internal combustion engine.
Figure 4:
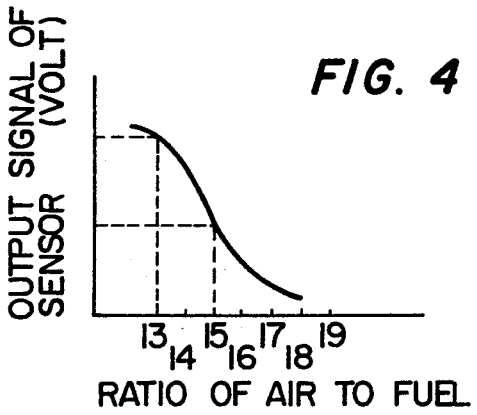
FIG. 4 is a graph illustrating output signal of a sensor of FIG. 1 as a function of the ratio of air to fuel.

Reference is now made to FIG. 1, wherein there is illustrated a conventional feedback system for automatically controlling the mass ratio of air to fuel of the air-fuel mixture being applied to an internal combustion engine. A sensor 2, such as an oxygen analyzer, for sensing a component of exhaust gases is provided in an exhaust pipe 4 to be exposed to the exhaust gases of an internal combustion engine, and the sensor 2 generates an electrical signal representing the sensed component. The magnitude of the signal from the sensor 2 increases with decrease of the mass ratio of air to fuel as shown in FIG. 4. The signal from the sensor 2 is then fed to a differential signal generator 6 which generates an output signal proportional to a differential value between the applied signal and a reference signal $S_R$. The reference signal is previously so determined as to have an optimum value to regulate the mass ratio of air to fuel (stoichiometric ratio 14.8, for example) in order that, when a so-called three-way catalytic reactor is employed for example, the reactor may reduce noxious components, i.e., hydrocarbon, carbon monoxide (CO) and oxides of nitrogen ($NO_X$) as much as possible.

In the aforementioned conventional feedback control system, however, there is encountered a defect that it is difficult or impossible to apply a rich air-fuel mixture at cold engine start. The present invention has, therefore, for its object to incorporate an improved differential signal generator into the above-mentioned conventional feedback control system, by which the difficulty defined above is overcome. The differential signal generator according to the present invention serves to automatically supply an optimum or rich air-fuel mixture to the engine at cold engine start and also under engine cold operation. This will be hereinafter discussed in detail in conjunction with the accompanying drawings of FIGS. 2–9. In the above, the reference signal $S_R$ is usually generated within the differential signal generator 6, however, alternatively, a suitable reference signal generator (not shown) can be independently provided in addition to the generator 6. The output signal from the generator 6 is then fed to the following stage, viz., a control circuit 8. The differential signal thus applied to the control circuit 8 is reversed in polarity therein with respect to a predetermined level in order that a control signal derived from the circuit 8 can regulate the mass ratio to a reverse direction. The control signal is then fed to an actuator 10. In the above, the predetermined level is previously decided considering effective reduction of the noxious components under usual engine operation. The actuator 10, which is, for example, an electromagnetic valve, regulates the mass ratio of the air-fuel mixture applied through a carburetor 12 to the engine. In the above, it is understood that the carburetor 12 can be replaced by an electronic fuel injection valve, etc. The present invention is not directly concerned with the control circuit 8, the actuator 10, and the carburetor 12, so that further detailed discussion thereabout will be omitted.

Figure 2:
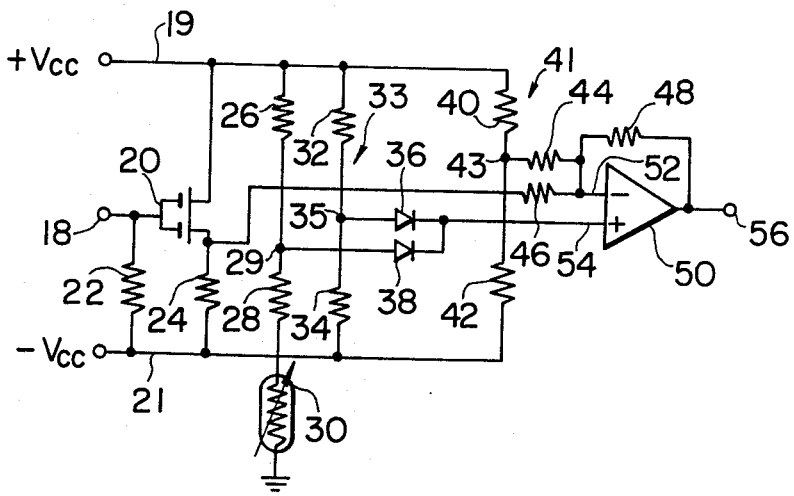
FIG. 2 is a first preferred circuit diagram embodying the present invention.

Turning to FIG. 2, wherein there is illustrated in detail a first preferred circuit embodying the present invention. The first preferred circuit corresponds to the differential signal generator 6 of FIG. 1. A terminal 18 is provided for receiving the electrical signal from the sensor 2 applying the same to the base of a transistor amplifier 20. The amplifier 20 is preferably a FET (field effect transistor) to obtain a high input impedance. The gate of the transistor 20 is connected through a resistor 22 to a negative power line 21, the source thereof directly to a positive power line 19, and the drain thereof through a resistor 24 to the negative power line 21 and also through a resistor 46 to a reverse input terminal 52 of a differential amplifier 50. A voltage divider 33, which consists of two resistors 32 and 34, is connected between the positive and the negative power lines developing a fixed reference signal $v_1$ at a junction 35 between the resistors 32 and 34. The junction 35 is connected through a diode 36 to a non-reverse input terminal 54. A series circuit made up of resistors 26, 28 and a temperature sensitive element 30 such as a thermistor is connected between the positive power line 19 and the ground. A thermistor, as is well known, has a high negative temperature coefficient of resistance, so its resistance decreases as temperature rises, in other words, its conductivity increases with increase of its atmospheric temperature. In the present embodiment, the thermistor 30 is attached to an engine itself for sensing directly its temperature or arranged to sense a engine temperature. As shown, a junction 29 between the resistors 26 and 28 is connected through other diode 38 to the terminal 54 of the differential amplifier 50. The diodes 36 and 38 are so arranged that higher voltage of the voltages developed at the junctions 29 and 35 is supplied to the input terminal 54. Between the positive and the negative power lines 19 and 21 connected is other voltage divider 41 consisting of resistors 40 and 42. The divided voltage appearing at a junction 43 is added through a resistor 44 to the output signal from the amplifier 20. From an output terminal 56 an output signal is derived which is proportional to a differential value between the signals applied to the two input terminals 52 and 54. The output terminal 56 is connected to the control circuit 8 in FIG. 1 and also to the input terminal 52 through a feedback resistor 48.

Operation of the first preferred embodiment of the FIG. 2 circuit will be discussed in conjunction with FIGS. 3, 4, 5a, and 5b. The main purpose of the present embodiment is, as is previously discussed, to ensure cold engine start by automatically making rich the air-fuel mixture applied to the engine. FIG. 4 is a graph illustrating the electrical signal derived from the sensor 2 as a function of the mass ratio of air to fuel. As seen from FIG. 4, the magnitude of the signal gradually continuously increases with decrease of the mass ratio of air to fuel. The signal from the sensor 2 is applied through the terminal 18 to the FET 20 which amplifies it feeding the amplified signal to the terminal 52 of the differential amplifier 50. On the other hand, the fixed voltage developing at the junction 43 is added to the signal from the amplifier 20. The resistance of the thermistor 30, due to its negative temperature coefficient, decrease with increase of its atmospheric temperature and vice versa. Thus, the voltage at the junction 29 decreases with increase of engine temperature as shown by a phantom line "*b*" in FIG. 3. The variable voltage at the junction 29 is applied to the anode of the diode 38. On the other hand, the fixed divided voltage ($v_1$, denoted by a dotted line "*a*" in FIG. 3) is applied to the anode of the diode 36. It is understood that, from the circuit arrangement of the diodes 36 and 38, the higher voltage of the voltages appearing at the junctions 29 and 35 is fed to the terminal 54. This means that the voltage applied to the terminal 54 can be changed in response to a predetermined engine temperature.

Figure 3:
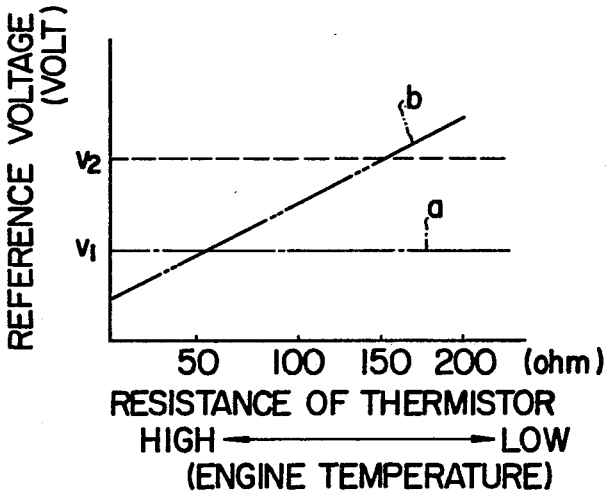
FIG. 3 is a graph illustrating a variation of a reference voltage generated in the FIG. 2 circuit.

The above-mentioned advantage of the first preferred embodiment of FIG. 2 will be further concretely discussed. Assuming that the engine temperature is comparatively low so that a rich air-fuel mixture is required at engine start and further assuming that the resistance of the thermistor 30 under this condition is 150 ohms as shown in FIG. 3, then the voltage at the junction 29 is $v_2$ so that this voltage $v_2$ is applied to the terminal 54 since the voltage in question is higher than the voltage $v_1$. Therefore, the magnitude of the differential signal from the differential amplifier 50 is large as compared with that in the case of hot engine start. Thus, the control unit 8 controls the actuator 10 in such a manner as to enrich the air-fuel mixture. Thereafter, as the engine temperature gradually rises, the voltage at the junction 29 is lowered along the line "*b*" as seen in FIG. 3, and finally when the resistance of the thermistor 30 decreases to 50 ohms in this case, the signal applied to the terminal 54 is in turn changed to $v_1$ and maintained thereat. The voltage $v_1$ is previously determined to supply an optimum air-fuel mixture (the mass ratio is about 14.8, for example) to the engine under usual hot engine operation in consideration of, for example, the reduction of harmful components of exhaust gases as previously mentioned.

Figure 5A:
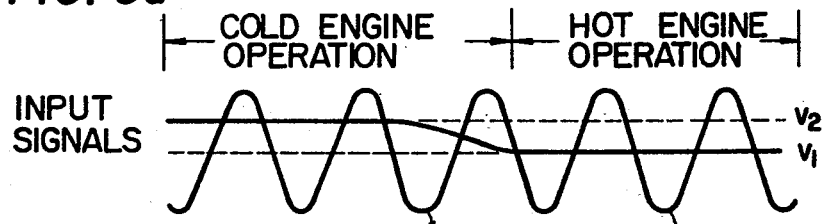
FIGS. 5*a* and 5*b* are waveform diagrams of input and output signals of a differential amplifier of FIG. 2.
Figure 5B:
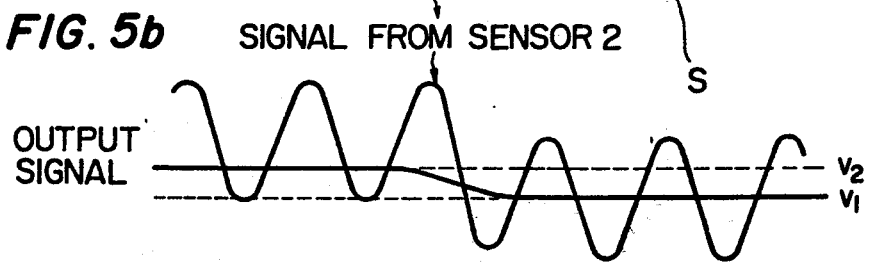

FIGS. 5*a* and 5*b* show waveforms of input and output signals of the differential amplifier 50 of FIG. 2, respectively, wherein the signals from the sensor 2 is illustrated as a sinusoidal wave for simplicity. As shown in FIG. 5*a*, the reference signal applied to the input terminal 54 is continuously changed in potential from $v_2$ to $v_1$ as the engine temperature rises. On the other hand, FIG. 5*b* shows the output signal representative of a differential value of the two input signals, which output signal is higher under cold engine operation than under hot engine operation. The control circuit 8, which receives the output signal from the differential amplifier, generates the output signal in order to control the actuator 10 in such a manner as to enrich the air-fuel mixture at cold engine start and under cold engine operation.

Figure 6:
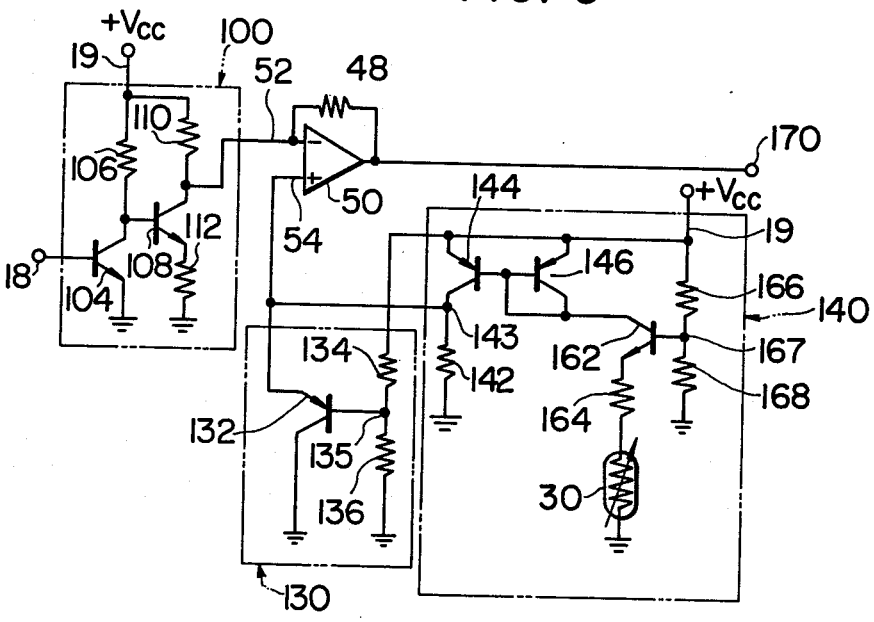
FIG. 6 is a second preferred circuit diagram embodying the present invention.
Figure 7:
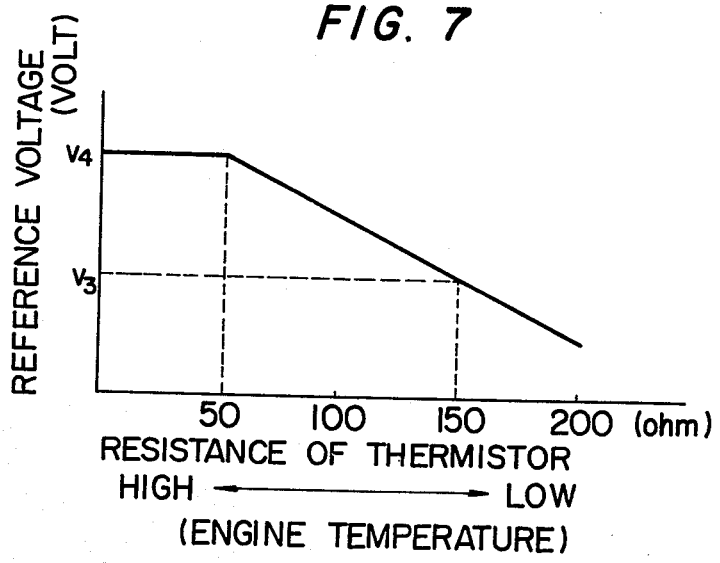
FIG. 7 is a graph illustrating a variation of a reference voltage generated in the FIG. 6 circuit.

Reference is now made to FIG. 6, wherein there is shown a second preferred circuit embodying the present invention. The second preferred circuit, as well as the first preferred one, corresponds to the differential signal generator 6 of FIG. 1. However, noticeable difference between the functions of the first and the second preferred circuits is that the reference signal $S_R$ of the latter increases in magnitude as the engine temperature rises as shown in FIG. 7, and that an output signal from an amplifier 100 is reversed in polarity.

The terminal 18 is provided for receiving the electrical signal from the sensor 2 applying the same to the base of a transistor 104 of the amplifier 100. The amplifier 100 is a conventional direct-coupled one, wherein two transistors 104 and 108 are provided. The emitter of the transistor 104 is connected through a resistor 106 to the positive power line 19 and also to the base of other transistor 108, and the collector thereof is directly grounded. The emitter of the transistor 108 is grounded through a resistor 112, and the collector thereof is connected through a resistor 110 to the positive power line 19 and also to an input terminal 52 of the differential amplifier 50. The amplifier 50 receives two kinds of signal at terminals 52 and 54 generating an output signal proportional to a differential value therebetween. The input terminal 52 is connected through the feedback resistor 48 to an output terminal 170 of the differential amplifier 50. The output signal from the amplifier 50 is then fed to the following control circuit 8 via the terminal 170. A reference signal, the magnitude of which is varied in response to the engine temperature, is applied to the input terminal 54 of the differential amplifier 50 from a junction 143 of a reference signal generator 140. The generator 140 includes two transistors 144 and 146 the emitters of which are connected to the positive power line 19 and the bases thereof connected directly each other, the collector of the transistor 144 being connected through a resistor 142 to the ground and the collector of the transistor 146 directly to its base. As shown, the collector of the transistor 146 is connected to the collector of other transistor 162. The base of the transistor 162 is in turn connected to a junction 167 between two resistors 166 and 168 which are connected in series between the ground and the positive power line 19 for developing a fixed potential at the junction 167. The emitter of the transistor 162 is connected to the ground through a resistor 164 and also the temperature sensitive element 30 (in this embodiment, a thermistor). The reference signal generator 140 serves to vary the reference voltage appearing at the junction 143 in response to the engine temperature in order to supply rich air-fuel mixture to the engine at cold engine start and under cold engine operation.

In addition to the reference signal generator 140, there is provided a limiting circuit 130 for limiting maximum value of the reference voltage developing at the junction 143. The limiting circuit 130 includes a transistor 132 the emitter of which is connected to the junction 143, the collector thereof being rounded, and the base thereof to a junction 135 between two resistors 134 and 136 which are coupled between the ground and the positive power line 19. The detailed function of the limiting circuit 130 is that the maximum value of the reference voltage at the junction 143 is determined by and is approximately equal to the fixed divided voltage at the junction 135. This is because when the reference voltage exceeds the fixed divided voltage at the junction 135, the transistor 132 is rendered conductive, however, instantly thereafter the reference voltage falls below the fixed divided voltage, resulting in the fact that the transistor 132 is rendered non-conductive. Therefore, the maximum value of the reference voltage is maintained approximately at the fixed divided voltage at the junction 135.

Operation of the second preferred embodiment of the FIG. 6 circuit will be hereinafter discussed in conjunction with FIGS. 4 and 7. The purpose of the present embodiment is similar to that of the first preferred embodiment except that, in short, the reference voltage increases with increase of the engine temperature. The electrical signal derived from the sensor 2 gradually continuously increases with decrease of the mass ratio of air to fuel as shown in FIG. 4. The signal from the sensor 2 is applied through the terminal 18 to the amplifier 100 the output signal of which is reversed in porality. In the first place, assuming that the engine temperature is low so that rich air-fuel mixture is required at cold engine start and further assuming that the resistance of the thermistor 30 under this condition is 150 ohms as shown in FIG. 7, then a current flowing throught the emitter and the collector of the transistor 144 and the resistor 142 is small, so that the reference voltage at the junction 143 is low ($v_3$ in FIG. 7). Therefore, the magnitude of the output signal derived from the differential amplifier 50 is small. This output from the amplifier 50 is then fed to the control circuit 8 of FIG. 1 which, however in the second preferred embodiment, must be modified to generate a control signal therefrom making the ratio of air to fuel larger as the magnitude of the signal applied rises. This is because the output signal of the amplifier 100 is reversed in polarity with respect to the input thereof and also the reference signal gradually continuously increases with increase of the engine temperature as seen in FIG. 7. Thereafter, as the engine temperature gradually rises, the reference voltage at the junction 143 increases as shown in FIG. 7, and finally when the resistance of the thermistor 30 decreases to 50 ohms, the reference voltage is equal to the voltage $v_4$ and maintained thereat as previously discussed. In the above, the voltage $v_4$ is previously determined to supply an optimum mass ratio of air to fuel under usual hot engine operation.

Figure 8:
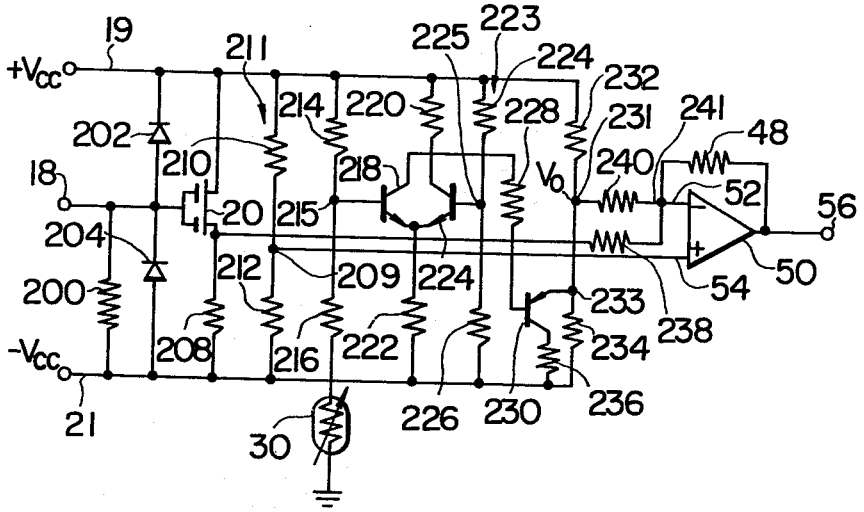
FIG. 8 is a third preferred circuit diagram embodying the present invention.

Finally, reference is now made to FIG. 8, wherein a third preferred circuit embodying the present invention is illustrated. The third embodiment, unlike the preceding two ones, has a characteristic that the signal from the sensor 2 is discretely varied in response to the engine temperature. Hereinafter, detailed circuit arrangement of the third embodiment will be described. The terminal 18 is provided for receiving the electrical signal from the sensor 2 applying the same to the gate of the FET 20. The gate is connected through a diode 202 to the positive power line 19, and also connected to the negative power line 21 through a parallel circuit made up of a resistor 200 and other diode 204. The source of the FET 20 is directly connected to the line 19. The drain thereof is connected through a resistor 208 to the line 21 and also through a resistor 238 to the input terminal 52 of the differential amplifier 50. Between the two lines 19 and 21 connected is a voltage divider 211 which consists of resistors 210 and 212. A junction 209 between the resistors 210 and 212 is directly connected to the input terminal 54 of the amplifier 50. The purpose of the provision of the voltage divider 211 is to feed a fixed reference voltage to the differential amplifier 50 from which a differential value between the fixed reference voltage and the signal applied to the terminal 52 is derived at the output terminal 56. The sensor 30 is connected between the ground and a series circuit consisting of two resistors 214 and 216, thereby to vary the voltage at a junction 215. The junction 215 is connected to the base of a transistor 218. The emitter of the transistor 218 is connected through a resistor 222 to the line 21 and the collector thereof connected through a resistor 228 to the base of a transistor 230. Other voltage divider 223, which consists of two resistors 224 and 226, is provided for developing a fixed divided voltage at a junction 225. The junction 225 is connected to the base of a transistor 224. The collector of the transistor 224 is connected through a resistor 220 to the line 19 and the emitter thereof to the emitter of the transistor 218. The transistors 218 and 224 are thus arranged so that the former is rendered conductive only when the voltage at the junction 215 exceeds the voltage at the junction 225. The emitter of the transistor 230 is connected to a junction 233 between two resistors 232 and 234 and the collector thereof connected through a resistor 236 to the line 21. The resistors 232 and 234 are connected in series between the positive and the negative power lines 19, 21. Voltage $v_0$ appearing at a junction 231 is discretely varied in response to the magnitude temperature as will be discussed later, so that the mangitude of the signal from the FET 20 is in turn discretely varied in that $v_O$ is added thereto through a resistor 240 at a junction 241. The added signal is then fed to the terminal 52. The differential amplifier 50 generates a differential value between the two signals applied as already discussed.

Figure 9:
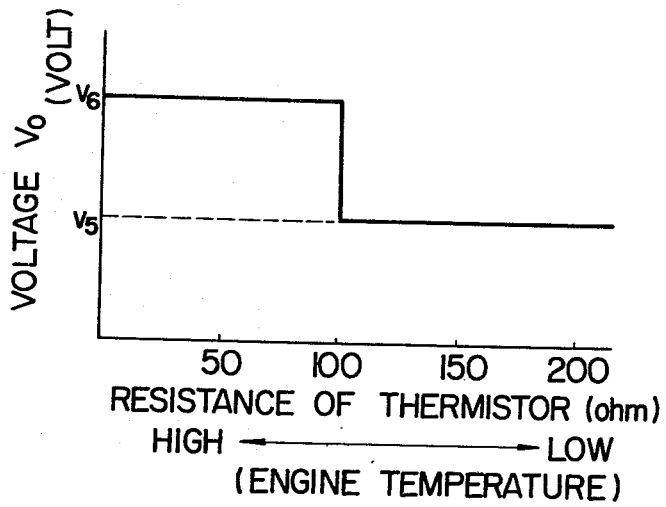
FIG. 9 is a graph illustrating a variation of a signal generated in the FIG. 8 circuit.

The operation of the third preferred embodiment will be hereinafter discussed in connection with FIG. 9. An important difference, particular to this embodiment, is that one of the inputs applied to the differential amplifier 50 is discretely varied in response to the engine temperature. The electrical signal derived from the sensor 2 gradually continuously increases with decrease of the mass ratio of air to fuel as shown in FIG. 4. The signal from the sensor 2 is applied through the terminal 18 to the FET 20 which amplifies it feeding the amplifier signal to the junction 241. In the first place, the following conditions are assumed: (1) the engine temperature is low so that rich air-fuel mixture is required at cold engine start; (2) the resistance of the thermistor 30 is, under the condition (1), more than 100 ohms (see FIG. 9); (3) the voltage at the junction 215 is higher than that at the junction 225 under the condition (2); (4) when the resistance of the thermistor 30 is less than 100 ohms, on the contrary, the voltage at the junction 215 is lower than that at the junction 225. Under the above assumption (that is, under cold engine temperature), the transistor 218 is rendered conductive, thereby to make the transistor 230 conductive. The voltage $v_0$ at the junction 231, therefore, is equal to a voltage divided by the resistors 232, and 236 ($v_5$ in FIG. 9). On the contrary, as the engine temperature rises, the voltage at junction 215 is lowered. Provided that the voltage at the junction 215 becomes lower than the fixed voltage at the junction 225, the transistor 218 is rendered non-conductive thereby to make in turn the transistor 230 non-conductive. Therefore, the voltage at the junction 231 increases substantially abruptly up to $v_6$ in FIG. 9. In the above, the voltage $v_6$ is previously determined to supply an adequate air-fuel mixture to the engine under usual engine operation.

From the foregoing, it is understood that, according to the present invention, cold engine start is ensured in the conventional feedback control apparatus. In the above description, the thermistor 30, which can be replaced by other suitable temperature sensitive element, is employed for sensing a temperature of engine cooling water, exhaust gases or engine lubricant. The thermistor 30 is attached to or disposed in a proper place for directly or indirectly sensing engine temperature. Furthermore, the differential amplifier 50 can be substituted by a comparator, and, in replacement of the sensor 2, any of other various sensors can be used which senses, for example, hydrocarbon, carbon monoxide, carbon dioxide, or oxides or nitrogen. Still furthermore, the caburetor 12 can be substituted by an electrically controlled fuel injection valves.

What is claimed is:

1. Apparatus for feedback control of the ratio of air to fuel of an air-fuel mixture supplied to an internal combustion engine, which apparatus comprises:

a first sensor for sensing a component of exhaust gases of an internal combustion engine and generating an electrical signal representative thereof;

a differential signal generator connected to the first sensor for generating an electrical signal representative of the differential value between the signal from the sensor and a reference signal; and control means connected to the differential signal generator for controlling an actuator in response to the differential value therefrom to regulate the mass ratio of air to fuel, the improvement comprising:

a second sensor (30) for sensing engine temperature being connected to the differential signal generator and continuously changing the reference signal value in response to the sensed engine temperature to optimize the mass ratio of air to fuel at cold engine start;

the differential signal generator including, a first and a second amplifier (20, 50), the first amplifier being connected to the first sensor for amplifying the electrical signal derived therefrom, a first signal generator (33) for generating a first signal with a fixed value, said first signal generator comprising a voltage divider for generating a divided voltage corresponding to the first signal and connected over a first diode (36) to the second amplifier, a second signal generator (26, 28) for generating a second signal, being connected to the second sensor, the second signal being variable in magnitude in response to the engine temperature to decrease with increase of the engine temperature, said second signal generator comprising a voltage divider for generating a second divided voltage corresponding to the second signal, the second signal generator being connected over a second diode (38) to the second amplifier, said second diode, means connecting the first and the second diodes in a configuration effective to apply a higher voltage of the first and the second divided voltage to the second amplifier, and the second amplifier being connected to the first and the second signal generator for selectively receiving the first and second signals as the reference signal and for generating the electrical signal representative of the differential value therebetween.

2. Apparatus for feedback control of the ratio of air to fuel of the air-fuel mixture being supplied to an internal combustion engine, which apparatus comprises:

a first sensor for sensing a component of exhaust gases of an internal combustion engine and generating an electrical signal representative thereof;

a differential signal generator being connected to the first sensor for generating an electrical signal representative of the differential value between the signal from the sensor and a reference signal; and control means connected to the differential signal generator for controlling an actuator in response to the differential value therefrom to regulate the mass ratio of air to fuel, wherein the improvement comprises:

a second sensor for sensing engine temperature being connected to the differential signal generator and continuously changing the reference signal value in response to the sensed engine temperature to optimize the mass ratio of air to fuel at cold engine start; and the differential signal generator including, a first amplifier (100) connected to the first sensor for amplifying the electrical signal derived therefrom, a reference signal generator (140) including the second sensor and generating the reference signal, the magnitude of the reference signal increasing with increase of the engine temperature, a second amplifier (50) connected to both the first amplifier and the reference signal generator for receiving the signal from the former and the reference signal from the latter, said second amplifier generating the signal representative of the differential value therebetween, and a limiting circuit for determining and maintaining a maximum value of the reference signal, the limiting circuit including a voltage divider and a transistor, said voltage divider comprising two resistors, connected between the positive power supply and the ground, the transistor having a control electrode connected to a junction between the two resistors of the voltage divider and one of the controlled electrodes thereof being grounded and the other controlled electrode thereof connected to the reference signal generator in order that the maximum value of the reference signal is approximately equal to a voltage at the junction between the two resistors of the voltage divider.

3. Apparatus for feedback control of the ratio of air to fuel to the air-fuel mixture being supplied to an internal combustion engine, which apparatus comprises:

a first sensor for sensing a component of exhaust gases of an internal combustion engine and generating an electrical signal representative thereof;

a differential signal generator connected to the first sensor for generating an electrical signal representative of the differential value between the signal from the sensor and a reference signal; and control means connected to the differential signal generator for controlling an actuator in response to the differential value therefrom to regulate the mass ratio of air to fuel, wherein the improvement comprises:

a second sensor for sensing engine temperature connected to the differential signal generator and continuously changing the reference signal value in response to the sensed engine temperature to optimize the mass ratio of air to fuel at cold engine start; and differential signal generator including, a first amplifier (100) being connected to the first sensor for amplifying the electrical signal derived therefrom, a reference signal generator (140) including the second sensor and generating the reference signal, the magnitude of the reference signal increasing with increase of the engine temperature, a second amplifier (50) connected to both the first amplifier and the reference signal generator for receiving the signal from the former and the reference signal from the latter, which second amplifier generates the signal representative of the differential value therebetween, and a limiting circuit (130) for determining and maintaining a maximum value of the reference signal, the reference signal generator comprising, a first (144) and a second (146) transistors each receiving a d.c. potential at one of the controlled electrodes and being connected to the other transistor through its control electrode, the other controlled electrode of the first transistor being grounded through a resistor (142) and the other controlled electrode of the second transistor connected to the control electrodes of the first and the second transistors, a voltage divider (166, 168), a third transistor the control electrode of which is connected to the voltage divider and one of the controlled electrodes thereof to the control electrodes of the first and the second transistors, and the other controlled electrode of the third transistor being grounded through a series circuit consisting of a resistor and the second sensor, the second sensor being a thermistor so that the resistance thereof decreases with increases of the engine temperature thereby to increase a voltage appearing at the other controlled electrode of the first transistor, which voltage corresponds to the reference signal fed to the second amplifier connected to the other controlled electrode of the first transistor.

4. Apparatus for feedback control of the ratio of air to fuel of the air-fuel mixture being supplied to an internal combustion engine, which apparatus comprises:

a first sensor for sensing a component of exhaust gases of an internal combustion engine and generating an electrical signal representative thereof;

a differential signal generator being connected to the first sensor for generating an electrical signal representative of the differential value between the signal from the sensor and a reference signal;

control means connected to the differential signal generator for controlling an actuator in response to the differential value therefrom to regulate the mass ratio of air to fuel, and wherein the improvement comprises:

a second sensor for sensing engine temperature, being connected to the differential signal generator and discretely changing the magnitude of the signal from the first sensor in response to the sensed engine temperature to optimize the mass ratio of air to fuel at cold engine start, the differential signal generator including, a first amplifier (20) connected to the first sensor for amplifying the electrical signal derived therefrom, a reference signal generator (210, 211, 212) for generating the reference signal therefrom, a control circuit for discretely changing the magnitude of the signal from the first amplifier to substantially abruptly increase the signal when the engine temperature increases in excess of a predetermined value, and a second amplifier (50) connected to both the first amplifier and the reference signal generator for receiving the signal from the former and the reference signal from the latter, said second amplifier generating the signal representative of the differential value therebetween, the second sensor comprising a thermistor, the reference signal generator comprising a first voltage divider, generating a fixed divided voltage corresponding to the magnitude of the reference signal, means for applying the fixed divided voltage to the second amplifier, the control circuit being connected to the second sensor for generating a control signal added to the signal from the first amplifier, the second sensor alternatively determining lower and higher values of the control signal in response to the engine temperature such that when the engine temperature is below the predetermined value the control signal assumes the lower value, and when the engine temperature exceeds the predetermined value the control signal assumes the higher value, the control circuit comprising, a second voltage divider consisting of two resistors (214, 216) connected in series to the second sensor so that the divided voltage thereof is variable in response to the variable resistance of the second sensor, a third voltage divider (223) consisting of two resistors (224, 226) generating a fixed divided voltage therefrom, a first transistor (218) the control electrode of which is connected to a junction between the two resistors of the second voltage divider and one of the controlled electrodes thereof to a negative power supply and the other controlled electrode thereof to the control electrode of a second transistor (230), a third transistor (224) the control electrode of which is connected to a junction between the two resistors of the third voltage divider and one of the controlled electrodes thereof to a positive power supply and the other controlled electrode thereof to the one of the controlled electrodes of the first transistor, one of the controlled electrodes of the second transistor being connected to a junction, at which the control signal develops, between a first and a second resistors (232, 234) connected between the positive and the negative power supplies, one of the controlled electrodes of the second transistor being connected through a third resistor (236) to the negative power supply, wherein when the engine temperature is less than the predetermined value, the divided voltage of the second voltage divider is greater than the fixed divided voltage of the third voltage divider so that the first transistor is rendered conductive rendering in turn the second transistor conductive thereby to cause the control signal to assume the lower value, and when the engine temperature exceeds the predetermined value, the divided voltage of the second voltage divider is less than the fixed divided voltage of the third voltage divider so that the first transistor is rendered nonconductive rendering in turn the second transistor nonconductive thereby to cause the control signal to assume the higher value.

5. Apparatus for feedback control of the ratio of air to fuel of an air-fuel mixture being supplied to an internal combustion engine, which comprises:

a first sensor for sensing a component of exhaust gases from an internal combustion engine and generating an electrical signal representative thereof;

a differential signal generator connected to the first sensor for generating an electrical signal representative of the differential value between the signal from the sensor and a reference signal; and control means connected to the differential signal generator for controlling an actuator in response to the differential value therefrom to regulate the mass ratio of air to fuel, the improvement comprising:

a second sensor for sensing engine temperature connected to the differential signal generator and continuously changing the reference signal value in response to the sensed engine temperature to optimize the mass ratio of air to fuel at cold engine start; and the differential signal generator including, a first amplifier (100) connected to the first sensor for amplifying the electrical signal derived therefrom, a reference signal generator (140) including the second sensor and generating the reference signal, the magnitude of the reference signal increasing with increase of the engine temperature, a second amplifier (50) connected to both the first amplifier and the reference signal generator for receiving the signal from the former and the reference signal from the latter, for generating the signal representative of the differential value therebetween, and a limiting circuit for maintaining a maximum value of the reference signal, the limiting circuit including, a voltage divider, which includes two resistors, connected between a positive power supply and ground, and a transistor the control electrode of which is connected to a junction between the two resistors of the voltage divider, one of the controlled electrodes thereof being grounded, and the other controlled electrode thereof connected to the reference signal generator in order that the maximum value of the reference signal is approximately equal to a voltage at a junction between the two resistors of the voltage divider.

6. Apparatus for feedback control of the ratio of air to fuel of an air-fuel mixture being supplied to an internal combustion engine, which apparatus comprises:

a first sensor for sensing a component of exhaust gases from an internal combustion engine and generating an electrical signal representative thereof;

a differential signal generator connected to the first sensor for generating an electrical signal representative of the differential value between the signal from the sensor and a reference signal; and control means connected to the differential signal generator for controlling an arcuator in response to the differential value therefrom to regulate the mass ratio of air to fuel, the improvement comprising:

a second sensor for sensing engine temperature being connected to the differential signal generator and continuously changing the reference signal value in response to the sensed engine temperature to optimize the mass ratio of air to fuel at cold engine start; and the differential signal generator including, a first amplifier (100) connected to the first sensor for amplifying the electrical signal derived therefrom, a reference signal generator (140) including the second sensor and generating the reference signal, the magnitude of the reference signal increasing with increase of the engine temperature, a second amplifier (50) connected to both the first amplifier and the reference signal generator for receiving the signal from the former and the reference signal from the latter, generating the signal representative of the differential value therebetween, and a limiting circuit for maintaining a maximum value of the reference signal, the reference signal generator including, a first (144) and a second (146) transistors each receiving a d.c. potential at one of the controlled electrodes and being connected to the other transistor through its control electrode, a resistor (142), the other controlled electrode of the first transistor being grounded through said resistor (142) and the other controlled electrode of the second transistor connected to the control electrodes of the first and the second transistors, a voltage divider, a third transistor the control electrode of which is connected to the voltage divider and one of the controlled electrodes thereof to the control electrodes of the first and the second transistors, and the other controlled electrode of the third transistor being grounded through a series circuit consisting of a resistor and the second sensor, and the second sensor comprising a thermistor so that the resistance thereof decreases with increases of the engine temperature, thereby to increase a voltage appearing at the other controlled electrode of the first transistor, and the lastmentioned voltage corresponding to the reference signal applied to the second amplifier connected to the other controlled electrode of the first transistor.

7. Apparatus for feedback control of the ratio of air to fuel of an air-fuel mixture being supplied to an internal combustion engine, which apparatus comprises:

a first sensor for sensing a component of exhaust gases from an internal combustion engine and generating an electrical signal representative thereof;

a differential signal generator connected to the first sensor for generating an electrical signal representative of the differential value between the signal from the sensor and a reference signal; and control means connected to the differential signal generator for controlling an actuator in response to the differential value therefrom to regulate the mass ratio of air to fuel, the improvement comprising:

a second sensor for sensing engine temperature being connected to the differential signal generator and continuously changing the reference signal value in response to the sensed engine temperature to optimize the mass ratio of air to fuel at cold engine start; and the differential signal generator including, a first amplifier (100) connected to the first sensor for amplifying the electrical signal derived therefrom, a reference signal generator (140) including the second sensor and generating the reference signal, the magnitude of the reference signal increasing with increase of the engine temperature, a second amplifier (50) connected to both the first amplifier and the reference signal generator for receiving the signal from the former and the reference signal from the latter, generating the signal from the latter, generating the signal representative of the differential value therebetween, and a limiting circuit (130) for determining and maintaining a maximum value of the reference signal, the limiting circuit including, a voltage divider, which includes two resistors connected between a positive power supply and ground; and a transistor the control electrode of which is connected to a junction between the two resistors of the voltage divider, one of the controlled electrodes thereof being grounded, and the other controlled electrode thereof connected to the reference signal generator in order that the maximum value of the reference signal is approximately equal to a voltage at the junction between the two resistors of the voltage divider.

8. Apparatus for feedback control of the ratio of air to fuel of the air-fuel mixture being supplied to an internal combustion engine, which apparatus comprises:

a first sensor for sensing a component of exhaust gases from an internal combustion engine and generating an electrical signal representative thereof;

a differential signal generator connected to the first sensor for generating an electrical signal representative of the differential value between the signal from the sensor and a reference signal; and control means connected to the differential signal generator for controlling an actuator in response to the differential value therefrom to regulate the mass ratio of air to fuel, the improvement comprising:

a second sensor for sensing engine temperature being connected to the differential signal generator and continuously changing the reference signal value in response to the sensed engine temperature to optimize the mass ratio of air to fuel at cold engine start; and the differential signal generator including a first amplifier (100) connected to the first sensor for amplifying the electrical signal derived therefrom, a reference signal generator (140) including the second sensor and generating the reference signal, the magnitude of the reference signal increasing with increase of the engine temperature, a second amplifier (50) connected to both the first amplifier and the reference signal generator for receiving the signal from the former and the reference signal from the latter, generating the signal representative of the differential value therebetween, and a limiting circuit (130) for determining and maintaining a maximum value of the reference signal;

the reference signal generator including, a first transistor (144) and a second transistor (146) each receiving a d.c. potential at one of the controlled electrodes thereof and being connected to the other transistor through its control electrode, the other controlled electrode of the first transistor being grounded through a resistor (142) and the other controlled electrode of the second transistor connected to the control electrodes of the first and the second transistor, said resistor (142), a voltage divider, a series circuit consisting of a resistor and the second sensor, a third transistor the control electrode of which is connected to the voltage divider and one of the controlled electrodes thereof to the control electrodes of the first and the second transistors, and the other controlled electrode of the third transistor being grounded through said series circuit consisting of said resistor and said second sensor, and the second sensor comprising a thermistor the resistance thereof decreasing with increases of the engine temperature, thereby to increase a voltage appearing at the other controlled electrode of the first transistor, and corresponding to the reference signal applied to the second amplifier connected to the other controlled electrode of the first transistor.

9. Apparatus for feedback control of the ratio of air to fuel of the air-fuel mixture being supplied to an internal combustion engine, which apparatus comprises:

a first sensor for sensing a component of exhaust gases from an internal combustion engine and generating an electrical signal representative thereof;

a differential signal generator connected to the first sensor for generating an electrical signal representative of the differential value between the signal from the sensor and a reference signal; and control means connected to the differential signal generator for controlling the differential signal generator for controlling an actuator in response to the differential value therefrom to regulate the mass ratio of air to fuel, and the inmprovement comprising:

a second sensor for sensing engine temperature, connected to the differential signal generator and discretely changing the magnitude of the signal from the first sensor in response to the sensed engine temperature to optimize the mass ratio of air to fuel at cold engine start; and the differential signal generator including a first amplifier (20) connected to the first sensor for amplifying the electrical signal derived therefrom, a reference signal generator (210, 211, 212) for generating the reference signal therefrom, a control circuit for discretely changing the magnitude of the signal from the first amplifier to substantially abruptly increase the signal when the engine temperature increases in excess of a predetermined value, and a second amplifier (50) connected to both the first amplifier and the reference signal generator for receiving the signal from the former and the reference signal from the latter, generating the signal representative of the differential value therebetween, the second sensor being a thermistor, the reference signal generator comprising a first voltage divider, generating a fixed divided voltage corresponding to the magnitude of the reference signal and applied to the second amplifier, the control circuit being connected to the second sensor for generating a control signal added to the signal from the first amplifier, the second sensor alternatively determining a lower value and a higher value of the control signal in response to the engine temperature such that when the engine temperature is below the predetermined value the control signal corresponds to the lower value, and when the engine temperature exceeds the predetermined value the control signal corresponds to the higher value, the control circuit including, a second voltage divider, consisting of two resistors (214,216) connected in series to the second sensor so that the divided voltage thereof is variable in response to the variable resistance of the second sensor, a third voltage divider (223) consisting of two resistors (224,226) generating a fixed dividing voltage therefrom, a first transistor (218) a control electrode of which is connected to a junction between the two resistors of the second voltage divider, one of the controlled electrodes thereof being connected to the negative power supply, and the other controlled electrode thereof being connected to the control electrode of a second transistor (230), a third transistor (224) the control electrode of which is connected to a junction between the two resistors of the third voltage divider, one of the controlled electrodes thereof being connected to the positive power supply, and the other controlled electrode thereof being connected to one of the controlled electrodes of the first transistor, one of controlled electrodes of the second transistor being connected to a junction, at which the control signal develops, between a first and a second resistors (232,234) connected between the positive and the negative power supplies, one of the controlled electrodes of the second transistor being connected through a third resistor (236) to the negative power supply, wherein when the engine temperature is less than the predetermined value, the divided voltage of the second voltage divider being greater than the fixed divided voltage of the third voltage divider so that the first transistor is rendered conductive rendering in turn the second transistor conductive thereby to cause the control signal to take the lower value, and when the engine temperature exceeds the predetermined value, the divided voltage of the second voltage divider is less than the fixed divided voltage of the third voltage divider so that the first transistor is rendered nonconductive rendering in turn the second transistor nonconductive thereby to cause the control signal to assume the higher value.

* * * * *